US009434897B2

(12) United States Patent
Hannemann et al.

(10) Patent No.: US 9,434,897 B2
(45) Date of Patent: Sep. 6, 2016

(54) DIVIDED CENTRAL TUBE OF A COMBINED QUENCHING AND SCRUBBING SYSTEM FOR AN ENTRAINED FLOW GASIFICATION REACTOR

(71) Applicant: SIEMENS AKTIENGESELLSCHAFT, München (DE)

(72) Inventors: Frank Hannemann, Freiberg (DE); André Herklotz, Halsbrücke (DE); Horst Hoppe, Chemnitz (DE); Tino Just, Freiberg (DE); Manfred Schingnitz, Freiberg (DE); Darek Schmauch, Brotterode (DE)

(73) Assignee: SIEMENS AKTIENGESELLSCHAFT (DE)

( * ) Notice: Subject to any disclaimer, the term of this patent is extended or adjusted under 35 U.S.C. 154(b) by 172 days.

(21) Appl. No.: 14/491,041

(22) Filed: Sep. 19, 2014

(65) Prior Publication Data

US 2015/0075072 A1 Mar. 19, 2015

(30) Foreign Application Priority Data

Sep. 19, 2013 (DE) ..... 10 2013 218 830

(51) Int. Cl.
*C10K 1/02* (2006.01)
*C10K 1/08* (2006.01)
*C10K 1/10* (2006.01)

(52) U.S. Cl.
CPC . *C10K 1/02* (2013.01); *C10K 1/08* (2013.01); *C10K 1/101* (2013.01)

(58) Field of Classification Search
CPC ..... C10K 1/101
See application file for complete search history.

(56) References Cited

U.S. PATENT DOCUMENTS 4,326,856 A * 4/1982 Muenger ..... B01D 45/08 252/373
4,367,076 A 1/1983 Peise et al.
(Continued)

FOREIGN PATENT DOCUMENTS

CN 101003754 B 7/2011
DE 145860 A3 1/1981
(Continued)

OTHER PUBLICATIONS

Schmalfeld J. et al: Die Veredlung und Umwandlung von Kohle, Technologien und Projekte 1970 bis 2000 in Deutschland, Deutsche Wissenschaftliche Gesellschaft für Erdöl, Erdgas und Kohle e.V., Kapitel 4.4.2 Gaskombinat Schwarze Pumpe-Verfahren (GSP), pp. 537-552, Dec. 2008.

*Primary Examiner* — Kaity Handal
(74) *Attorney, Agent, or Firm* — Ostrolenk Faber LLP

(57) ABSTRACT

Devices for a three-stage scrubbing system for treatment of hot crude gases and liquid slag by an entrained flow gasification. Crude gas and slag are conducted downward into a water bath in a central tube. The upper part of the central tube consists of a double-threaded tube screen welded in a gas-tight manner, in which water is injected directly as the first scrubbing and cooling stage in the interior thereof. In the water bath, a bubble column is formed, which simultaneously constitutes the second scrubbing and cooling stage. Surface bodies arranged in three layers increase the scrubbing effect. After leaving the bubble column, the crude gas is again sprayed with water in a cavity, wherein one or more nozzle rings are disposed. This forms the third scrubbing stage. The crude gas then leaves the quenching and scrubbing apparatus in steam-saturated form at 200-220° C. and is sent to further treatment.

26 Claims, 4 Drawing Sheets

(56) References Cited

U.S. PATENT DOCUMENTS

| | | | | | |
|---|---|---|---|---|---|
| 4,474,584 | A * | 10/1984 | Koog | C10J 3/485 | 252/373 |
| 4,581,899 | A * | 4/1986 | von Klock | C10J 3/485 | 261/112.1 |
| 4,605,423 | A * | 8/1986 | Koog | C10J 3/485 | 48/69 |
| 4,705,542 | A * | 11/1987 | Gilmer | B01J 3/02 | 48/197 R |
| 4,731,097 | A * | 3/1988 | Kohnen | C10J 3/86 | 261/116 |
| 4,852,997 | A * | 8/1989 | Segerstrom | C10J 3/526 | 48/210 |
| 4,919,688 | A * | 4/1990 | Suggitt | C10J 3/485 | 49/69 |
| 5,324,336 | A | 6/1994 | Child | | |
| 5,364,996 | A * | 11/1994 | Castagnoli | C10J 3/46 | 208/407 |
| 5,401,282 | A * | 3/1995 | Leininger | C10J 3/06 | 252/373 |
| 5,464,592 | A * | 11/1995 | Brooker | C10J 3/485 | 110/171 |
| 6,032,467 | A * | 3/2000 | Oshita | C10J 3/66 | 60/39.12 |
| 6,312,482 | B1 * | 11/2001 | James | C10J 3/485 | 48/202 |
| 7,090,707 | B1 * | 8/2006 | Barot | C10J 3/485 | 48/113 |
| 7,794,514 | B2 * | 9/2010 | Yu | C10J 3/20 | 48/62 R |
| 8,240,259 | B2 | 8/2012 | Fischer et al. | | |
| 8,770,555 | B2 | 7/2014 | Schulze et al. | | |
| 9,028,569 | B2 * | 5/2015 | Tiwari | C10J 3/84 | 48/119 |
| 2007/0044381 | A1 | 3/2007 | Holle et al. | | |
| 2008/0042373 | A1 * | 2/2008 | Wilson | C10J 3/485 | 277/631 |
| 2008/0142408 | A1 * | 6/2008 | Eilers | C01B 3/36 | 208/61 |
| 2008/0222955 | A1 * | 9/2008 | Jancker | C10J 3/06 | 48/67 |
| 2009/0047193 | A1 * | 2/2009 | Corry | C10J 3/06 | 422/200 |
| 2009/0199474 | A1 * | 8/2009 | Leininger | C10J 3/52 | 48/69 |
| 2009/0202403 | A1 * | 8/2009 | Jimenez-Huyke | C01B 3/36 | 422/198 |
| 2010/0143216 | A1 * | 6/2010 | Ten Bosch | C10J 3/485 | 422/207 |
| 2010/0313442 | A1 * | 12/2010 | Russell | F23K 1/04 | 34/468 |
| 2011/0162277 | A1 * | 7/2011 | Russell | C10J 3/72 | 48/77 |
| 2012/0055087 | A1 * | 3/2012 | Ullrich | C10J 3/487 | 48/61 |
| 2015/0080620 | A1 * | 3/2015 | Boon | C10K 3/04 | 585/240 |

FOREIGN PATENT DOCUMENTS

| | | | |
|---|---|---|---|
| DE | 224045 | A1 | 6/1985 |
| DE | 265051 | A3 | 2/1989 |
| DE | 4446803 | C2 | 5/1998 |
| DE | 19718131 | C2 | 10/1999 |
| DE | 19952754 | A1 | 5/2001 |
| DE | 102005041930 | A1 | 3/2007 |
| DE | 102006031816 | B4 | 4/2008 |
| DE | 102007042543 | A1 | 3/2009 |
| EP | 0677567 | B1 | 9/1997 |

* cited by examiner

DIVIDED CENTRAL TUBE OF A COMBINED QUENCHING AND SCRUBBING SYSTEM FOR AN ENTRAINED FLOW GASIFICATION REACTOR

CROSS-REFERENCE TO RELATED APPLICATION

The present non-provisional patent application claims the benefit of priority from German Patent Application No. 102013218830.7, filed Sep. 19, 2013, the entire contents of which are incorporated herein by reference.

Divided central tube of a combined quenching and scrubbing system for an entrained flow gasification reactor

TECHNICAL BACKGROUND

The invention relates to a combined quenching and scrubbing system for the cooling and cleaning of crude gases from an entrained flow gasification plant, in which fuel dusts are reacted with oxygen and moderators such as steam or carbon dioxide at temperatures between 1200-1900° C. and pressures up to 10 MPa to give a crude gas rich in CO and $H_2$.

Fuel dusts are understood to mean finely ground coals of different carbonization level, dusts formed from biomasses, products of thermal pre-treatment, such as cokes, torrefaction products and fractions having high calorific values from communal and commercial residual and waste materials. The fuel dusts can be supplied to the gasification as a gas/solid or liquid/solid suspension. The gasification reactors can be provided with a cooling screen or with a refractory lining, as shown by the patent documents DE 4446803 and EP 0677567. In various systems introduced in industry, crude gas and the molten slag can be discharged separately or together from the reaction space of the gasification apparatus, as described, for example, in DE 19718131.

Entrained flow gasification, because of the fuel particles ground to a dust and short reaction times in the gasification space, causes an elevated dust content in the crude gas. Depending on the reactivity of the fuel, this entrained dust consists of soot, unconverted fuel particles and fine particles of slag and ash. The size varies between coarse particles having diameters greater than 0.5 mm and fine particles having a diameter down to 0.1 μm. The separability of the particles from the crude gas depends on this diameter, but also on the composition thereof. In principle, a distinction can be made between soot and ash or slag particles, soot particles generally being smaller and more difficult to separate from the crude gas. Slag particles have a higher density and hence better separability but, in contrast, have a higher hardness and hence erosive action. This leads to increased wear in the separators and crude gas-conducting lines, and can cause safety-relevant leaks and lifetime restrictions. For the removal of the dusts resulting from the fuels, various scrubbing systems are being used.

The prior art to date is described in patent document DE 102005041930 and in "Die Veredlung von Kohle" [The Addition of Value to Coal], DGMK, Hamburg, December 2008, Schingnitz, chapter on "GSP-Verfahren" [GSP Processes]. According to this, the crude gasification gas leaves the gasification space together with the slag formed from the fuel ash at temperatures of 1200-1900° C. and is cooled in a downstream quench space by injection of excess water and freed of the slag and, to a small extent, of entrained dust, it being possible for the quench space to be configured as a cavity quencher or provided with a crude gas-conducting central tube. A cavity quench system is disclosed, for example, in DE 102007042543, in which the crude gas that leaves the gasification space is sprayed with water and drawn off in the lower section beneath a roof construction.

DE 102006031816 exhibits a clear quench space entirely without internals, with injection of quenching water at one or more levels in such an amount that the crude gas is cooled and saturated with steam, and the excess quenching water is drawn off in the lower section alone or together with deposited slag. Variants with a central tube are disclosed by the patents DE 19952754, in which the central tube takes the form of a Venturi tube, DD 145860, in which the crude gas at the end of the central tube is subjected to additional scrubbing in the form of an airlift pump, and DD 265051, where elements for distribution of the crude gas flowing out at the end of the central tube are supposed to ensure uniform flow outward. CN 101003754 B describes an immersed quenching apparatus with a central tube, in which the hot crude gas from the gasification reactor is conducted together with the likewise hot slag downward into a water bath and flows upward as a gas/water suspension within the annular gap of the guide tube, which takes the form of a double tube. The gas/water separation takes place at the upper end of the guide tube. The gas/water suspension which flows upward in the annular gap is said to protect the inner central tube from overheating.

The solution according to patent document DE 102007042543 has the disadvantage that the cavity, as a result of pipelines of relatively high diameter for the removal of crude gas and the roof construction, offers deposition surfaces for entrained slags and dusts, which, as experience has shown, leads to blockages. DE 102006031816 requires homogeneous flow of the hot crude gas out of the gasification space, because there could otherwise be the risk of thermal overloading of the pressure-bearing vessel walls. The arrangement of a Venturi tube according to DE 19952754 can lead to unwanted variations in pressure in the gasification space, and these can barely be compensated for by means of control technology because of their short duration of action. Internals in the quench space and scrub space, as in the patents DD 265051 and DD 224045, can lead, as a result of the puzzolanic properties particularly of the fine dust components in the case of particular coal and ash types, to accumulating deposits having the strength of cement, which likewise lead to blockages and to an increase in pressure drop. This risk likewise exists in the solution according to CN 101003754 B. Should the gap between the inner and outer tubes of the central tube become blocked, the hot crude gas will flow downward in the uncooled inner tube, which can lead to the thermal destruction thereof and additionally endangers the pressure casing of the quench space as a result of overheating.

SUMMARY OF THE INVENTION

The problem addressed by the invention is that of providing a quenching and scrubbing system in which the hot gasification gas fed in on the input side and the entrained liquid slag firstly undergoes cooling with simultaneous deposition of particles, such as slag and dust, and the crude gas that leaves the quenching and scrubbing system on the output side secondly has an elevated hydrogen content.

This object is achieved by a crude gas scrubbing system disclosed herein.

In the inventive combined quenching and scrubbing system for cooling of the hot gasification gas and the entrained liquid slag, involving multistage cooling of the crude gas and contacting of the crude gas with quenching water, the conversion reaction that proceeds between carbon monoxide and steam provides an increased hydrogen content in the crude gas in conjunction with a substantial separation of particles out of the crude gas.

According to the invention, in addition to an injection of quenching and scrubbing water, the central tube is divided, the upper section receiving special configuration in the form of a tube wall which allows the additional cooling of the tube material. The central tube has, in the section facing the gas side, plating which protects the tube wall from corrosion, and the smooth surface prevents the caking of slag. Likewise in a particular configuration, nozzles are integrated through this tube wall, which enable the abovementioned supply of quenching and scrubbing water into the interior. The lower section of the central tube consists of smooth tube. Here, the cooling of crude gas and slag has advanced to such an extent that there is no risk of thermal overheating. At the end of the lower section, additional devices are provided, particularly for improvement of the scrubbing operation.

BRIEF DESCRIPTION OF THE DRAWINGS

The invention is elucidated hereinafter by a working example, with reference to four figures. The figures show.

DESCRIPTION OF AN EMBODIMENT

In the figures, identical designations denote identical elements.

Figure 1:
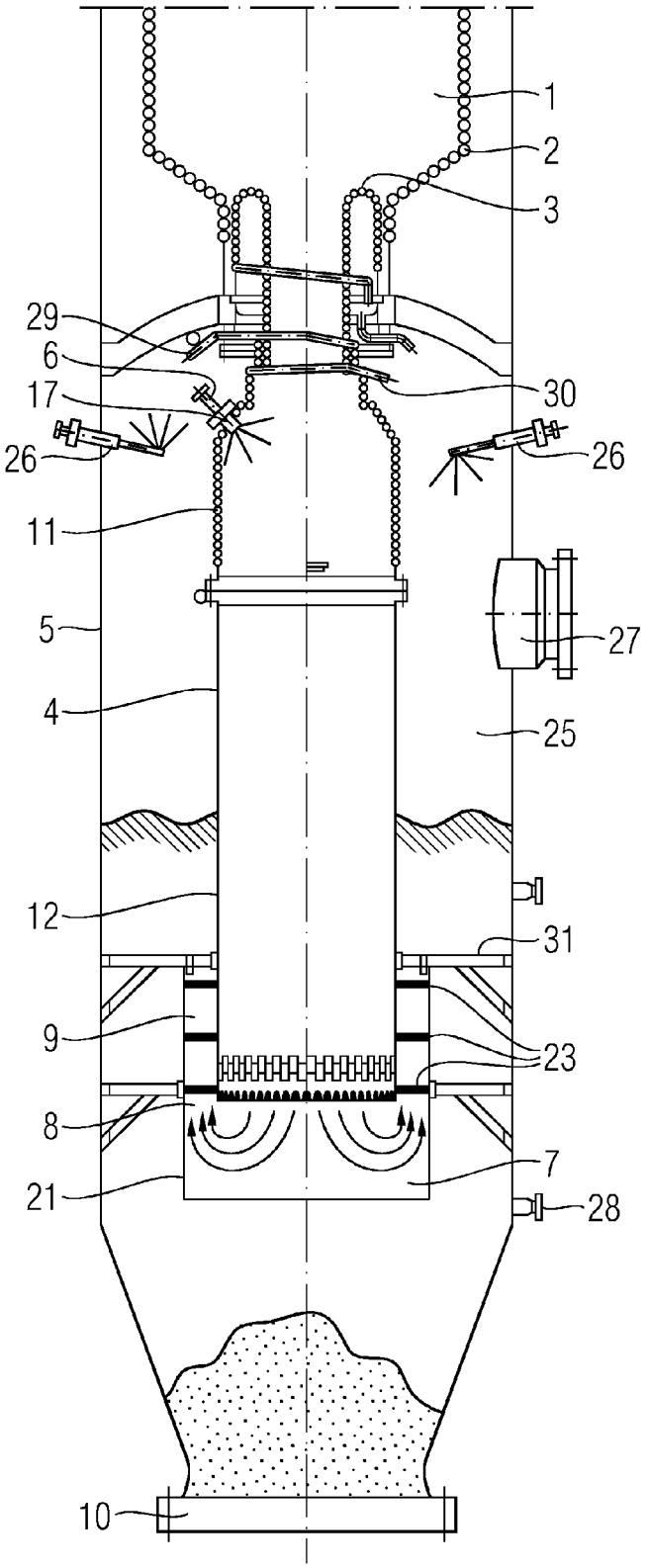
FIG. 1 an inventive quenching and scrubbing system.

In a gasification reactor 1 according to FIG. 1 with a reaction space bounded by a cooling screen 2, 68 t/h of coal dust are converted at a gross power output of 500 MW with addition of an oxygenous gasifying agent and of steam by means of autothermal partial oxidation at an operating pressure of 4.2 MPa to crude gas and liquid slag. The volume of moist crude gas produced, 145 000 $m^3$/h under normal conditions, and the 4.7 Mg/h of liquid slag formed from the fuel ash flow together with the crude gas at temperatures of 1700° C. through the gas and slag outlet 3 into the central tube 4 of the quenching and scrubbing apparatus 5. At the start of the central tube 4 is disposed the first primary cooling and scrubbing stage, represented by the water injection 6. The amount of water injected should be such that the crude gas and the liquid slag are cooled down to below the softening temperature of the slag of 800 to 1000° C. This temperature range enables, simultaneously with the catalytic action of the ash, a sufficiently high reaction rate of a conversion reaction, such that the water content in the crude gas rises by up to 6.4% by volume under these conditions. The central tube 4 conducts the partly cooled crude gas and the already solidified slag into the water bath 7, and the crude gas rises upward in the form of a bubble column 8 and arrives in the annular gap 9. Slag and coarse dust collect in the lower portion of the water bath 7 and are discharged from the system via the slag discharge 10.

Figure 2:
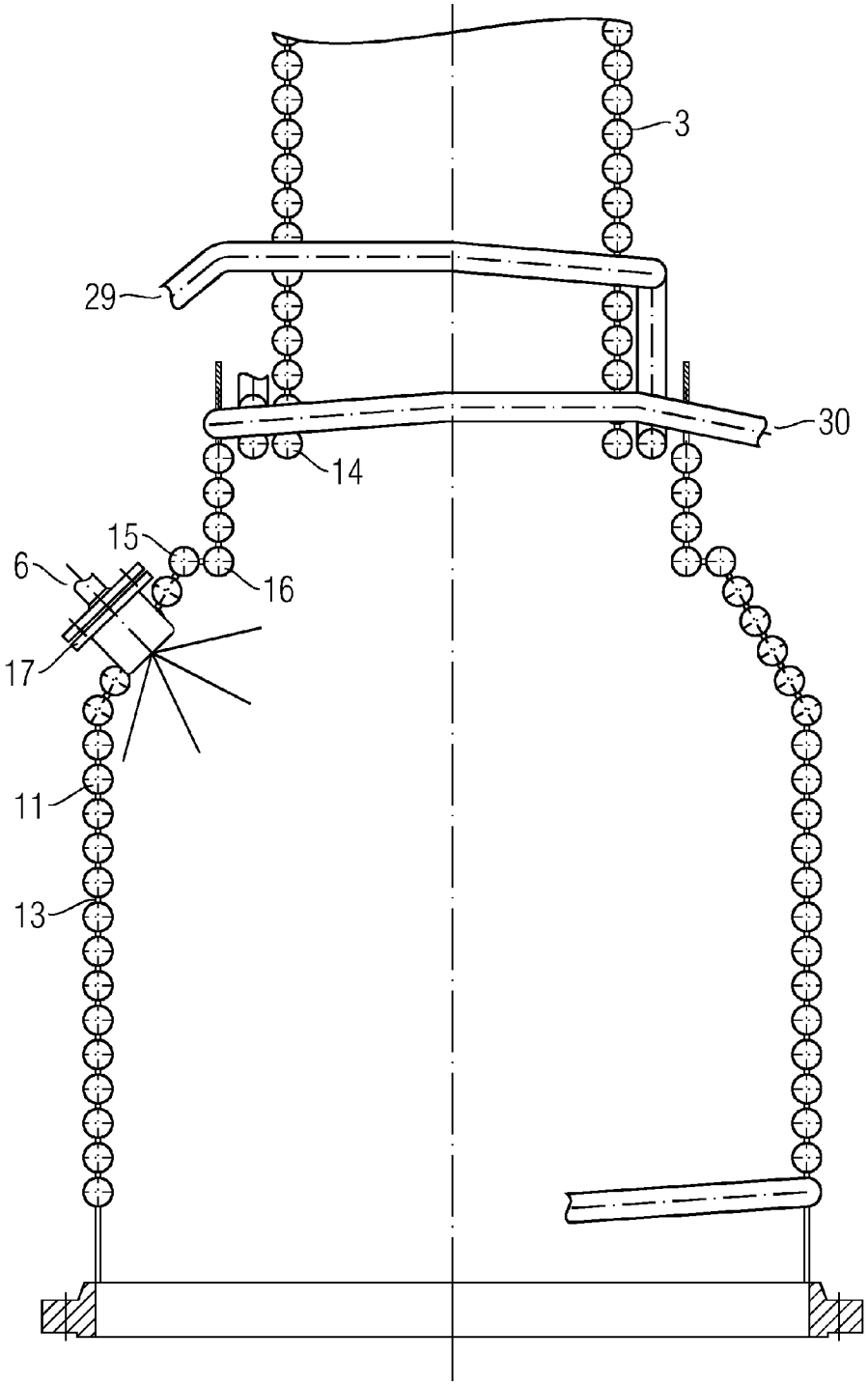
FIG. 2 the upper section of the central tube.

As shown in FIG. 2, the central tube 4 is divided into two, with only the central tube upper section 11 and its connection to the gas and slag outlet 3 shown. The central tube upper section 11 and central tube lower section 12 are screw-connected to one another, which facilitates assembly and disassembly. The central tube upper section 11 is water-cooled, in order to protect it from the high temperatures of incoming crude gas and slag. It consists of a double-stranded tube screen through which water flows, wherein the individual tubes are welded to one another by connecting elements 13 and the inside has plating. 29 and 30 show the cooling water inlet and outlet. The central tube upper section 11, which takes up about one third of the length of the overall central tube, can thus be formed by a bifilar wound tube. The central tube upper section 11 first of all has a cylindrical neck with connection to the gas and slag outlet 3, forms a first slag drip-off edge 14 therewith, and then widens to the lower cylindrical section. At the transition piece 15 is a second slag drip-off edge 16 which allows slag still flowing downward to drip off into the clear space. The central tube upper section 11 thus essentially has a bell jar shape widening in the downward direction, with a slag drip-off edge formed at at least one abrupt widening of the diameter. In the region of the continuous widening of the diameter of the central tube upper section 11 are disposed nozzles for water injection 6 into the center of the tube screen and hence into the stream of crude gas and slag. The nozzles 6, which are preferably directed obliquely downward, are disposed outside the slag drip-off edge, which counteracts blocking of the nozzles.

Figure 3:
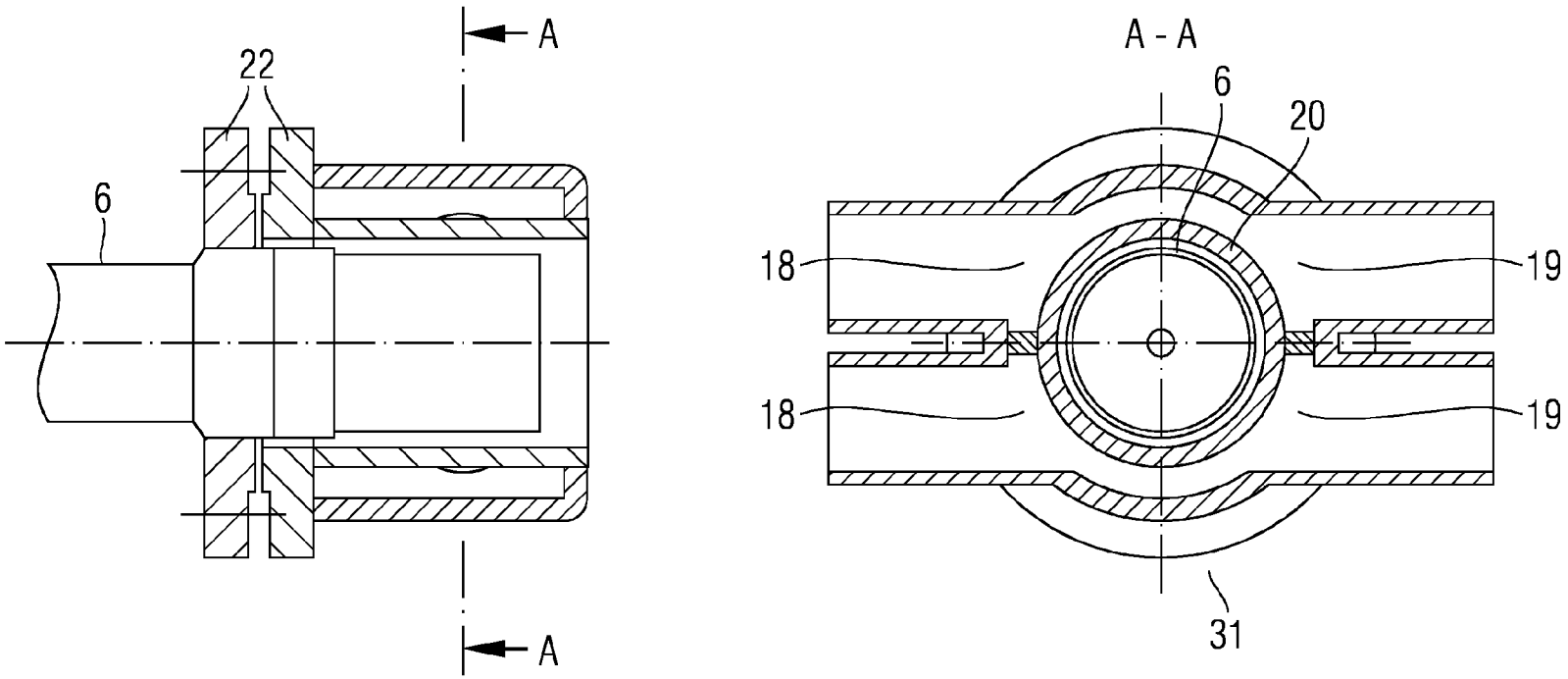
FIG. 3A is an end view of the nozzle aperture in the upper section of the central tube.
FIG. 3B is a side view of the nozzle in FIG. 3A.

The nozzles for water injection 6 are conducted through the welded tube screen of the central tube upper section 11 via a nozzle aperture 17 of a particular construction according to FIGS. 3A and 3B. The nozzle aperture 17, with its four connection points 18 and 19, is inserted into the gaps between two adjacent windings of the wound tube screen.

The width of the nozzle aperture 17 is configured such that it can be fitted into the distance between one winding and the third adjacent winding away from it in the wound tube screen. The nozzle aperture 17 has a central cylindrical seat 20 for a nozzle 6. Two parallel tube sections for separate guiding of the cooling water in two adjacent windings of the wound tube screen are conducted around the seat for the nozzle such that a cross-sectional constriction of the tube sections is substantially avoided. The avoidance of a cross-sectional constriction is brought about by virtue of the tube section, in the region where it is conducted around the seat for the nozzle, being narrower in one plane and correspondingly broader in the plane at right angles thereto. The nozzle aperture 17 is incorporated into the tube screen at the points 18 and 19, as a result of which cooling water flow is possible. The nozzle 6 is inserted into a water-cooled ring 20 and sealed tight via a flange connection 22.

A connecting element construction serves as a guide for the central tube lower section 12 in axial direction, in order to enable thermal expansion. For this purpose, eight connecting elements 31 are welded to the inner wall of the pressure casing of the quencher 5 and a ring 32 which guides the central tube lower section and can absorb radial forces.

Between the central tube lower section 12 and the pressure casing of the quencher 5, a lower guide tube 21 is connected to the connecting element construction such that the exiting crude gas flows upward in the annular space or gap 9 formed as a bubble column 8 and forms a secondary cooling and scrubbing stage. The lower end of the lower guide tube 21 is disposed at a lower level than the lower end of the central tube lower section 12, such that the crude gas ascends in the annular gap 9 as bubble column 8. The upper end of the lower guide tube 21 is disposed at a lower level than the surface of the water bath 7. Water entrained from the bubble column 8 in the annular gap 9 flows downward in the annular gap between the lower guide tube 21 and pressure casing of the quencher 5, forming a circuit. Particles which are entrained from the water flowing downward are separated out toward the slag discharge 10.

Figure 4:
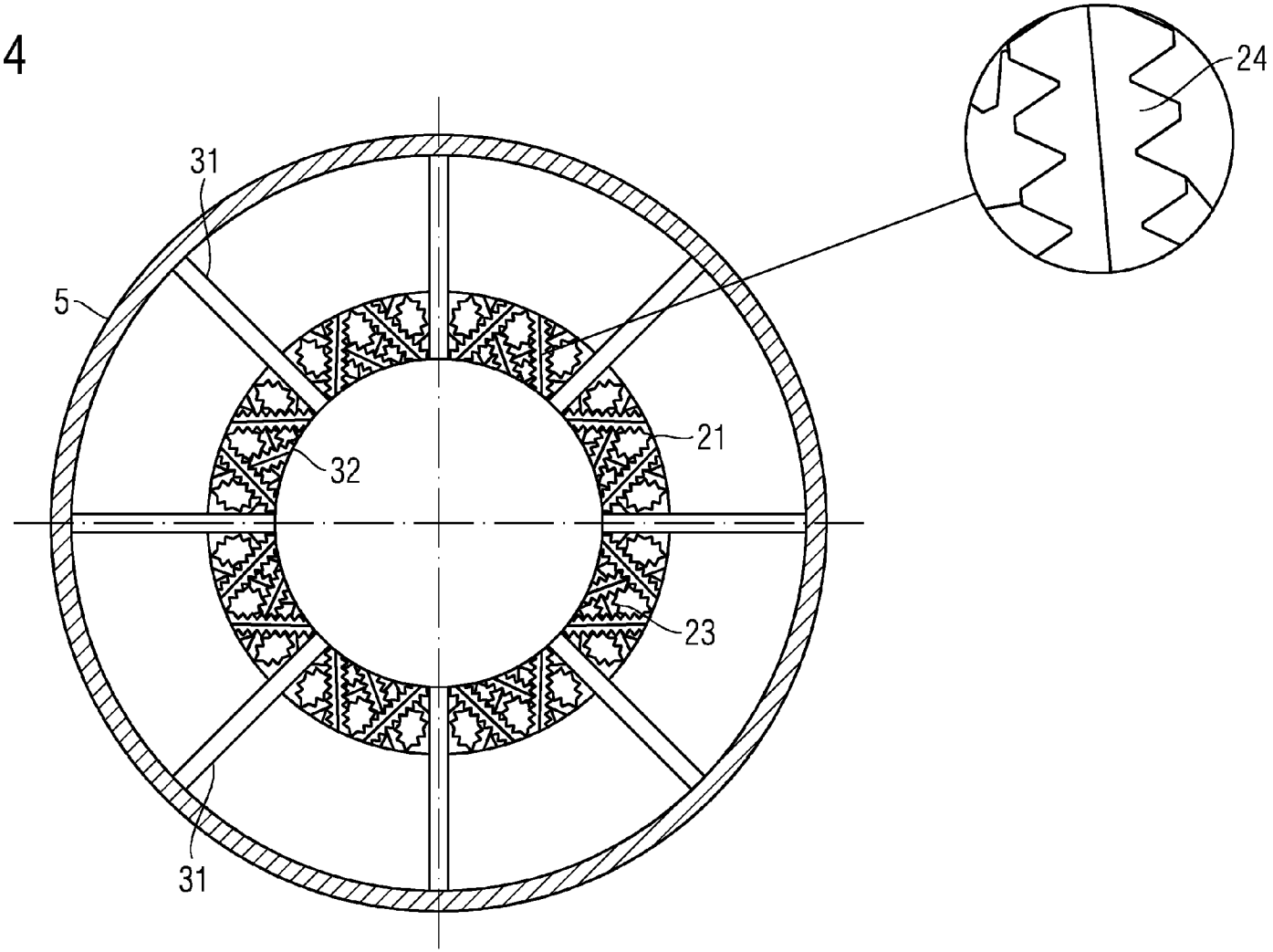
FIG. 4 a device for enhancing the scrubbing effect.

Referring to FIGS. 1 and 4, to improve the scrubbing effect, surface bodies in several layers are incorporated into the annular gap 9 such that they cross one another to define a grid 23. The grid 23 may be executed with segments fitted between the connecting element construction fixed to the pressure casing. The grid is coarse meshed, having relatively wide recesses. Offset angled metal sheets or end plates 24, are shown in FIG. 4. The end plates are staggered with respect to each other. The end plates are inserted into the recesses forming a fine mesh grid. The angled metal sheets are executed as 90° segments for simplified assembly and are introduced into the pressure vessel via a manhole or via the crude gas outlet 27. The angled metal sheets are secured via screw or clamp connections in a connecting element construction welded to the pressure vessel.

The bubble column 8 which forms in the annular gap 9 constitutes a second cooling and scrubbing stage. A surface body disposed in the annular gap, by virtue of its angled metal sheets, brings about a restriction in the bubble size, as a result of which the contact between ascending crude gas and water bath 7 is improved, which increases the deposition level of particles entrained in the crude gas into the water bath. The deposition level is increased further when the angled metal sheets are arranged offset with respect to one another in different planes. To enhance the scrubbing effect, surface bodies 23 might be arranged in three different horizontal planes.

The crude gas which flows upward in the cavity 25 downstream of the annular gap 9 is contacted with further water through one or more nozzle ring(s) 26 as the third cooling and scrubbing stage, in order to continue the cleaning and remove further dust components. The nozzle ring 26 shown in FIG. 1 is disposed above the crude gas outlet 27. FIG. 1 illustrates an upward spraying nozzle at the left and downward spraying nozzle at the right side. In an example, nozzles in a ring alternate between upward spraying and downward spraying.

The steam-saturated crude gas at 200-220° C. leaves the quenching and scrubbing apparatus 5 via the crude gas outlet 27 for further treatment. The excess quenching water is removed in a controlled manner from the water bath 7 via the discharge 28, in order to be able to maintain the required water level. The excess water is cleaned and fed back again in the circuit.

The invention also comprises an apparatus for a combined quenching and scrubbing system for the cooling and cleaning of crude gases from an entrained flow gasification plant, in which hot crude gas and liquid slag from the gas and slag outlet 3 are passed in a water-filled central tube 4 into a water bath 7, in which the central tube 4 is divided into two, wherein the central tube upper section 11 takes the form of a tube screen and undergoes direct cooling, and the central tube lower section 12 transfers the precooled gas and the precooled slag into the water bath 7, forming a bubble column 8.

LIST OF REFERENCE NUMERALS

1 gasification reactor
2 cooling screen
3 gas and slag outlet
4 central tube
5 quenching and scrubbing apparatus, quencher
6 nozzle
7 water bath
8 bubble column
9 annular gap
10 slag outlet
11 central tube upper section
12 central tube lower section
13 connecting elements
14 first slag drip-off edge
15 transition piece
16 second slag drip-off edge
17 construction of nozzle aperture
18, 19 connections to the tube screen with cooling water input and output
20 annular insert, cylindrical seat for nozzle 6
21 lower guide tube
22 flange connection
23 surface bodies in three layers, grid
24 offset angled metal sheets
25 cavity
26 nozzles in the cavity
27 crude gas outlet
28 discharge of the excess water
29 cooling water inlet
30 cooling water outlet
31 connecting element
32 ring

The invention claimed is:

1. A crude gas scrubbing system configured and operable for having a high separation level of particles in an entrained flow gasification unit for the reaction of ash-containing fuels with a gasifying agent containing free oxygen to give a crude gas having a high hydrogen content, the system comprising a gasification reactor operable at temperatures of 1200 to 1900° C. and process pressures up to 10 MPa for processing the fuel through the reactor and for converting the fuel to crude gas and liquid slag, a quencher arranged beneath the gasification reactor, a gas and slag outlet from the reactor into the quencher for transferring the crude gas and liquid slag into the quencher, a central tube in the quencher and connected to the gas and slag outlet and the central tube also dips into a water bath at a lower end of the quencher, an upper section of the central tube comprises a tube screen through which cooling water flows, and a lower section of the central tube comprises a smooth tube, in the region of the tube screen an injector injects quenching water into the stream of crude gas and liquid slag, and wherein the tube screen is configured in the shape of an upright bell and comprises windings of a tube that are welded gas tight to one another for preventing passage of crude gas through the tube screen, at the lower end of the central tube the slag is separated out into the water bath and the crude gas rises upward within a bubble column outside the central tube, a crude gas outlet in the pressure casing of the quencher through which the crude gas leaves the quencher, the crude gas is sprayed from above with quenching water through at least one nozzle ring on a route of the crude gas between the water surface and the crude gas outlet.

2. The crude gas scrubbing system as claimed in claim 1, wherein the tube screen is configured as a multi-turn winding of a tube through which cooling water flows.

3. The crude gas scrubbing system as claimed in claim 1, wherein the tube screen has an inside which is plated.

4. The crude gas scrubbing system as claimed in claim 1, further comprising:

the tube screen has a cylindrical neck which overlaps the gas and slag outlet, and a first slag drip-off edge formed on an internal diameter of the tube screen at the overlap.

5. The crude gas scrubbing system as claimed in claim 1, wherein the tube screen comprises a transition piece that widens conically starting at a small diameter at the top portion of the transition piece, and a second slag drip-off edge formed on the small diameter portion of the transition piece.

6. The crude gas scrubbing system as claimed in claim 1, further comprising:

a nozzle aperture disposed in the tube screen, and configured to accommodate a nozzle, and the nozzle penetrates the tube screen for injecting quenching water into the stream of crude gas and liquid slag.

7. The crude gas scrubbing system as claimed in claim 6, wherein the nozzle aperture is disposed radially outside the slag drip-off edge.

8. The crude gas scrubbing system as claimed in claim 6, further comprising:

the nozzle aperture comprises two tube sections and an annular insert in the nozzle aperture, each tube section having connections into two adjacent ones of the windings of the tube screen such that the cooling water of the tube screen flows around the annular insert; and a nozzle secured by a flange connection in the seat of the annular insert.

9. The crude gas scrubbing system as claimed in claim 1, wherein a length ratio of the tube screen above to the smooth tube below is about 1 to 2.

10. The crude gas scrubbing system as claimed in claim 1, wherein the lower end of the central tube is concentrically surrounded by a guide tube, defining an annular space between the central tube and the guide tube.

11. The crude gas system as claimed in claim 10, further comprising:

a lower end of the guide tube arranged lower than the lower end of the central tube which leaves a gap between the central tube and the guide tube for slag discharge.

12. The crude gas system as claimed in claim 11, further comprising:

an upper end of the guide tube arranged lower than a surface of the water bath in the quencher.

13. The crude gas scrubbing system as claimed in claim 10, wherein a bubble column forms in the annular space between the central tube and the guide tube.

14. The crude gas scrubbing system as claimed in claim 1, further comprising:

the central tube has apertures distributed over a circumference of the central tube and close to the lower end of the central tube.

15. The crude gas scrubbing system as claimed in claim 1, further comprising:

the central tube has teeth distributed over the circumference of the central tube at the lower end of the central tube.

16. The crude gas scrubbing system as claimed in claim 1, further comprising:

a ring connected via connecting elements to an inner wall of the quencher, and the smooth tube is guided to slide through the ring.

17. The crude gas scrubbing system as claimed in claim 13, further comprising:

a grid disposed in at least one horizontal plane in the annular gap between the lower central tube and the guide tube.

18. The crude gas scrubbing system as claimed in claim 17, further comprising:

the grid is formed of a coarse mesh with relatively wide recesses;

metal end plates staggered with respect to others are inserted into the recesses forming a fine mesh grid.

19. The crude gas scrubbing system as claimed in claim 18, further comprising:

the grid has angled metal sheets arranged such that they overlap in a crosswise manner.

20. The crude gas scrubbing system as claimed in claim 17, wherein the grid is integrated between the connecting elements.

21. The crude gas scrubbing system as claimed in claim 1, wherein the crude gas outlet is disposed approximately at the level of a divide between the tube screen and the smooth tube.

22. The crude gas scrubbing system as claimed in claim 1, further comprising:

a nozzle ring disposed above the crude gas outlet.

23. The crude gas scrubbing system as claimed in claim 1, further comprising nozzles in the nozzle ring, with alternate ones of the nozzles spraying upward followed by nozzles spraying downward.

24. The crude gas scrubbing system as claimed in claim 1, wherein a velocity of the crude gas in the central tube is below 20 m/s.

25. The crude gas scrubbing system as claimed in claim 1, wherein the annular space takes the form of a cavity such that the crude gas in the cavity has a mean flow rate of less than 0.5 m/s.

26. The crude gas scrubbing system as claimed in claim 1, wherein the system is configured such that the crude gas is cooled in the quencher as far as the steam saturation temperature determined by the process pressure.

* * * * *